US010347446B2

(12) United States Patent
Ozil et al.

(10) Patent No.: US 10,347,446 B2
(45) Date of Patent: Jul. 9, 2019

(54) GAS BLAST SWITCH COMPRISING AN OPTIMIZED GAS STORAGE CHAMBER

(71) Applicant: General Electric Technology GmbH, Baden (CH)

(72) Inventors: Joel Ozil, Villeurbanne (FR); Quentin Rognard, Villeurbanne (FR); Othman Zakaria, Villeurbanne (FR); Damien Vancell, Villeurbanne (FR)

(73) Assignee: General Electric Technology GmbH, Baden (CH)

( * ) Notice: Subject to any disclaimer, the term of this patent is extended or adjusted under 35 U.S.C. 154(b) by 0 days.

(21) Appl. No.: 15/988,488

(22) Filed: May 24, 2018

(65) Prior Publication Data

US 2018/0342363 A1 Nov. 29, 2018

(30) Foreign Application Priority Data

May 24, 2017 (EP) ..... 17290071

(51) Int. Cl.

| | |
|---|---|
| ***H01H 33/56*** | (2006.01) |
| ***H01H 33/70*** | (2006.01) |
| ***H01H 33/91*** | (2006.01) |
| ***H01H 33/12*** | (2006.01) |
| ***H01H 33/64*** | (2006.01) |
| *H01H 33/90* | (2006.01) |

(52) U.S. Cl.

CPC ..... *H01H 33/56* (2013.01); *H01H 33/12* (2013.01); *H01H 33/64* (2013.01); *H01H 33/703* (2013.01); *H01H 33/91* (2013.01); *H01H 2033/568* (2013.01); *H01H 2033/902* (2013.01)

(58) Field of Classification Search

None

See application file for complete search history.

(56) References Cited

U.S. PATENT DOCUMENTS

| | | | | |
|---|---|---|---|---|
| 10,026,571 | B1 * | 7/2018 | Hermosillo | H01H 33/7046 |
| 2008/0314873 | A1 * | 12/2008 | Dahlquist | H01H 33/7023 218/53 |
| 2009/0107957 | A1 * | 4/2009 | Drews | H01H 33/74 218/53 |
| 2010/0219161 | A1 * | 9/2010 | Seeger | H01H 33/74 218/51 |
| 2013/0020285 | A1 * | 1/2013 | Schiffbauer | H01H 33/82 218/47 |

(Continued)

*Primary Examiner* — Truc T Nguyen

(74) *Attorney, Agent, or Firm* — Eversheds Sutherland (US) LLP

(57) ABSTRACT

To improve cooling performances of quenching gas in a gas blast switch comprising a gas channel connecting an arcing region to a gas storage chamber delimited by radially opposite inner and outer walls and axially opposite first and second end walls, a flow guiding radial wall extends in the gas storage chamber spaced from each wall delimiting the chamber, an opening of the gas channel into the gas storage chamber through the first end wall faces a space between the flow guiding radial wall and the inner wall, the outer wall includes a deflecting portion protruding in the gas storage chamber and facing the second end wall, and at least part of the deflecting portion is offset from the flow guiding radial wall in an axial direction oriented from the gas channel towards the gas storage chamber.

14 Claims, 10 Drawing Sheets

(56) References Cited

U.S. PATENT DOCUMENTS

| | | | | |
|---|---|---|---|---|
| 2013/0126481 | A1* | 5/2013 | Ozil | H01H 33/901 218/157 |
| 2013/0161289 | A1* | 6/2013 | Horinouchi | H01H 33/86 218/47 |
| 2014/0014623 | A1* | 1/2014 | Kehr | H01H 33/901 218/86 |
| 2014/0251957 | A1* | 9/2014 | Cemat | H01H 33/58 218/51 |
| 2015/0194280 | A1* | 7/2015 | Uchii | H01H 33/88 218/52 |
| 2015/0228427 | A1* | 8/2015 | Kim | H01H 33/121 218/11 |
| 2016/0005559 | A1* | 1/2016 | Kaneko | H01H 33/70 218/43 |

* cited by examiner

GAS BLAST SWITCH COMPRISING AN OPTIMIZED GAS STORAGE CHAMBER

FIELD OF INVENTION

Embodiments of the present invention relate to a gas blast switch, also known as switching or breaking chamber, of the type comprising two arcing contacts movable relative to one another along an axis from a closed to an open configuration, a main nozzle and an auxiliary nozzle both made from insulation-material and extending around the axis such as to delimit an arcing region, a gas storage chamber sometimes called thermal volume for storing quenching gas to be injected into the arcing region, and a gas channel extending between an outer surface of the auxiliary nozzle and an inner surface of the main nozzle and connecting the gas storage chamber to the arcing region through an opening in a first end wall delimiting the gas storage chamber.

Such gas blast switch may be included in a high-voltage or medium voltage gas-insulated circuit breaker, gas insulated substation or generator circuit breaker.

BACKGROUND OF THE INVENTION

In such gas blast switches, an AC current interruption is operated through two main successive stages, namely a pressurization stage and an arc extinction stage.

In the pressurization stage, as main contacts of the gas blast switch separate, electric current is carried through an arc between the male and female arcing contacts. The gas channel provides a path for feeding insulating gas heated by the arc, such as SF6 or alternatives to SF6, from the arcing region (a space enclosing a gap formed between the male and female arcing contacts) into the gas storage chamber, thereby inducing a pressure increase in the gas storage chamber.

Then, in the arc extinction stage, the direction of gas flow in the gas channel reverts and quenching gas, formed by high pressurized insulating gas previously stored in the gas storage chamber, flows into the arcing region through the gas channel. A blast of quenching gas thus cools the electric arc and enables the AC current to be interrupted.

A purpose of embodiments of the present invention is to improve the cooling performances of the quenching gas in such gas blast switch.

SUMMARY OF THE INVENTION

To this end, an object of embodiments of the present invention is a gas blast switch of the aforementioned type, wherein the gas storage chamber is delimited by respective surfaces of radially opposite inner and outer walls and of axially opposite first and second end walls, wherein a flow guiding radial wall extends in the gas storage chamber at a distance from each of the inner and outer walls and the first and second end walls, wherein the opening of the gas channel through the first end wall faces a first space between the flow guiding radial wall and the inner wall, wherein the surface of the outer wall comprises a deflecting portion protruding towards the inside of the gas storage chamber and facing the second end wall, wherein at least part of the deflecting portion is offset from the flow guiding radial wall in a direction parallel to the axis and oriented from the gas channel towards the gas storage chamber.

The flow guiding radial wall partly divides the gas storage chamber into two volumes, namely a first volume on the side of the gas channel and a second volume on the opposite side.

During the pressurization stage, insulating gas heated by an arc flows through the gas channel and enters into the gas storage chamber. Here, the relative position of the opening of the gas channel with respect to the first space enables such hot gas to flow mainly into the second volume.

The flow guiding radial wall and the deflecting portion cooperate to induce gas swirling between the second end wall and the flow guiding radial wall, thus minimizing mixing of gas heated by the arc on the one hand and cold gas previously stored in the first volume on the other hand.

Moreover, during the arc extinction stage, the spaces between the flow guiding radial wall and each of the inner and outer walls enable the hot gas from the second volume to push the cold gas from the first volume into the gas channel in efficient manner. This way, cold gas is ejected out of the gas channel into the arcing region before hot gas.

In other words, embodiments of the invention enable to minimize mixing of gas heated by the arc and cold gas previously stored in the gas chamber, and to maximize use of cold gas rather than heated gas as quenching gas.

As a consequence, embodiments of the invention make arc cooling more efficient.

In particular, such gas blast switch makes it possible to interrupt higher currents than gas blast switches of known types. The only way to do this with gas blast switches of known types is by using additional capacitors, which adds considerable drawbacks such as additional maintenance costs and reduced grid reliability. Embodiments of the present invention thus permit to avoid using such additional capacitors.

Moreover, incorporating such gas blast switch in a circuit breaker initially designed for 50 kA currents makes it possible to boost performances of such circuit breaker at a very reasonable cost, in particular without requiring the circuit breaker operating energy to be increased and without requiring changes in the dimensions of the circuit breaker.

As is widely known, in gas blast switches or switching chambers of the thermally-assisted puffer type, a single volume or chamber plays the role of a compression volume, since gas inside this volume is pressurized by a moving piston or puffer, and the role of a thermal volume, since gas pressure is increased by the arc thermal energy. In gas blast switches or switching chambers of the self-blast type, there are two distinct volumes or chambers, namely the thermal volume which is of fixed volume and which opens into the thermal channel, and the compression volume which is of variable volume and which is connected to the thermal volume through a valve.

In the present disclosure, the gas storage chamber may notably be the single volume of a thermally-assisted puffer type gas blast switch, or the so-called thermal volume of a self-blast type gas blast switch.

According to other aspects of embodiments of the invention, the gas blast switch includes one or more of the following features, taken alone or in any possible combination:

- the inner surface of the main nozzle extends towards the gas storage chamber by converging towards the outer surface of the auxiliary nozzle;
- the gas blast further includes an intermediate wall of annular shape connecting the flow guiding radial wall to the first end wall and having gas passage openings;
- the intermediate wall is fastened to the main nozzle;
- a combined passage section of the gas passage openings is at least equal to half of an outer surface of the intermediate wall;

the deflecting portion is concave towards the second end wall;

the deflecting portion is of conical shape converging towards the gas channel;

the deflecting portion is flat, orthogonal to the axis, and totally offset from the flow guiding radial wall in the direction parallel to the axis and oriented from the gas channel towards the gas storage chamber;

the outer wall comprises a rib having a side forming the deflecting portion;

the surface of the outer wall comprises a first portion connected to the first end wall and having a first diameter, and a second portion offset from the first portion in the direction parallel to the axis and oriented from the gas channel towards the gas storage chamber, wherein the second portion has a second diameter greater than the first diameter, and wherein the deflecting portion connects the first portion to the second portion;

a radial extent of the first space is greater than or equal to a radial distance between the inner surface of the main nozzle and the outer surface of the auxiliary nozzle at the opening of the gas channel through the first end wall;

the surface of the second end wall is at least partly of concave shape;

a radial distance between a radially inner end of the deflecting portion and a radially outer end of the flow guiding radial wall is inferior or equal to a radial extent of the first space;

the gas blast switch further comprises a compression chamber separated from the gas storage chamber by the second end wall, wherein the second end wall comprises an opening provided with a valve configured to close the opening when gas pressure in the gas storage chamber reaches a predetermined level.

BRIEF DESCRIPTION OF THE DRAWINGS

Embodiments of the invention will be better understood and other details, advantages and characteristics of it will become clear after reading the following description given as non-limitative example with reference to the appended drawings in which.

In these figures, identical reference numbers may denote identical or similar elements.

DETAILED DESCRIPTION

Figure 1:
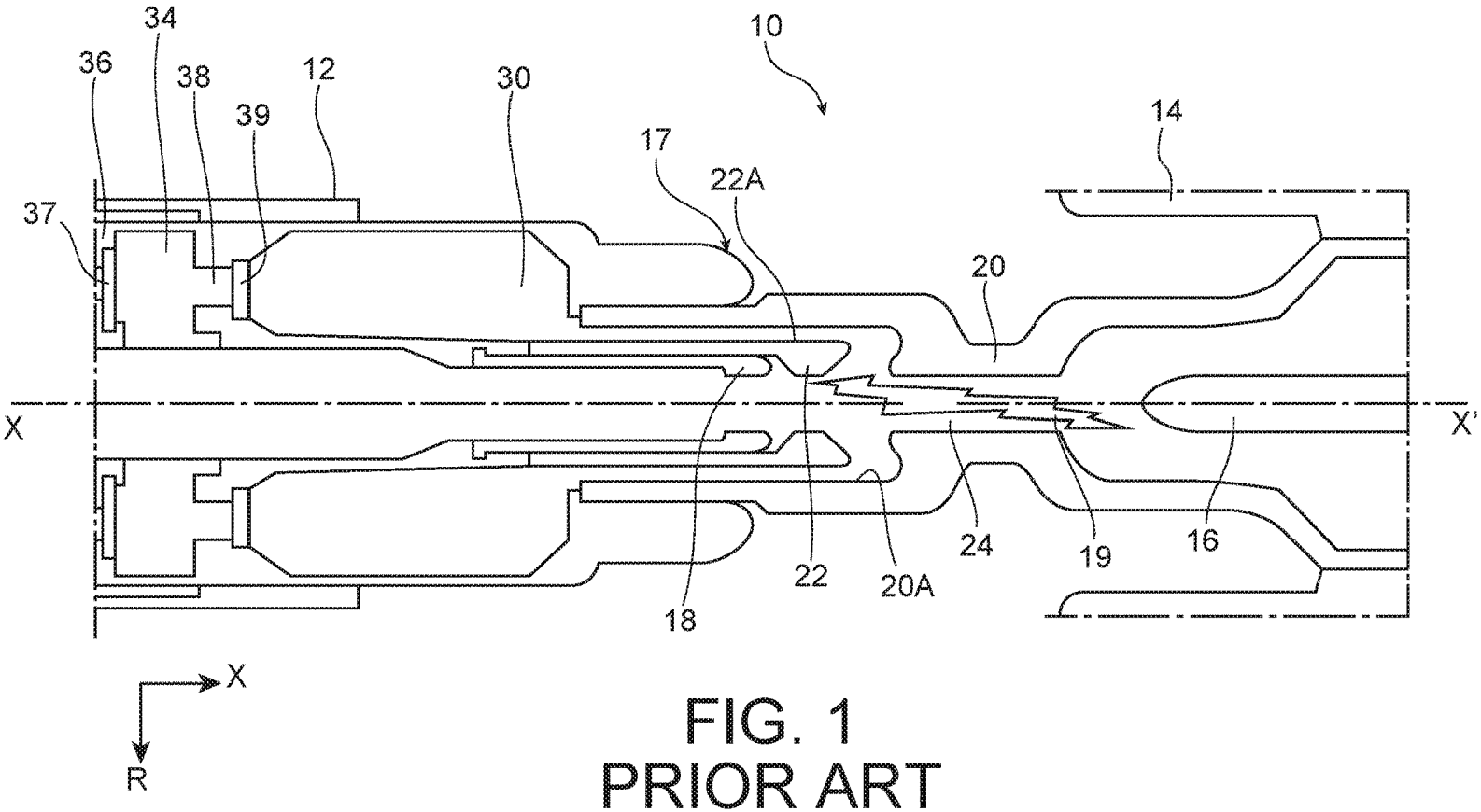
FIG. 1 PRIOR ART
FIG. 1 is a schematic fragmentary axial cross-sectional view of a known thermally-assisted self-blast type gas blast switch or switching chamber of a circuit breaker, shown in an open position.

A gas blast switch 10 of a known type is shown in FIG. 1. The gas blast switch 10 is for example a switching chamber of the thermally assisted self-blast type, which is part of a high voltage gas-insulated circuit breaker.

The gas blast switch 10 extends along a longitudinal axis XX' which globally constitutes an axis of revolution of the switch. In the present disclosure, the axial X and radial R directions are defined with reference to the longitudinal axis XX' (the radial direction R being orthogonal to the axis XX' and the axial direction X being parallel to said axis).

The gas blast switch 10 comprises a pair of permanent or main contacts 12, 14 which are movable relative to one another along the axis XX'. In the illustrated example, contact 14 is stationary whereas contact 12 is movable along the longitudinal axis XX', under the action of an operating member (not shown).

The gas blast switch 10 also includes a pair of arcing contacts 16, 18 which are also movable relative to one another along the axis XX'. In the illustrated example, arcing contact 16 is mechanically connected to the permanent contact 14 and is thus stationary, whereas arcing contact 18 is connected to a movable assembly 17 comprising the movable permanent contact 12.

The gas blast switch 10 is enclosed in a casing (not shown) containing an insulating gas, such as SF6 (sulfur hexafluoride) or an alternative gas for example composed of CO2 and additional elements.

Generally speaking, when electric current flowing through the permanent contacts 12 and 14 is to be interrupted, the gas blast switch is operated so as to separate the permanent contacts from each other. The arcing contacts 16 and 18 separate shortly after that, therefore establishing an electric arc 19 between these arcing contacts. Such arc then has to be quenched.

To that end, the gas blast switch 10 of FIG. 1 conventionally includes a main nozzle 20 made of insulating material and an auxiliary nozzle 22 also made of insulating material. The main and auxiliary nozzles 20, 22 contribute to delimiting an arcing region 24 where the electric arc 19 forms when the arcing contacts 16 and 18 separate. The main and auxiliary nozzles 20, 22 are for example secured to the arcing contact 18.

A gas storage chamber 30 or thermal volume is for example defined inside the movable assembly 17. This gas storage chamber 30 defines a fixed volume that is brought in translation with the movable assembly 17 when the contacts separate.

The gas storage chamber 30 communicates with a gas channel 32 which opens out into the arcing region 24. The gas channel 32 thereby puts the gas storage chamber 30 into fluidic communication with the arcing region 24. Such gas channel 32 is delimited by an outer surface 22A of the auxiliary nozzle 22 and an inner surface 20A of the main nozzle 20.

In the illustrated example, another chamber or volume referred to as the compression chamber 34 is arranged behind the gas storage chamber 30 and is notably delimited by a fixed back wall 36 which forms a piston or puffer which makes the volume of the compression chamber 34 vary when the contacts separate. This back wall 36 is conventionally fitted with an over-pressure valve 37. The compression chamber 34 communicates with the gas storage chamber 30 through a passageway 38 which gets closed by a valve 39 as soon as gas pressure inside the gas storage chamber 30 reaches a predefined level.

When a nominal electric current is to be interrupted, the thermal energy of the arc 19 is not sufficient to raise the gas pressure inside the gas storage chamber 30 at the above-mentioned predefined level, such that the valve 39 remains open. Compression of the insulating gas that will quench the arc mainly takes place in the compression chamber 34 and is further increased in the gas storage chamber 30 by thermal energy from the arc.

Now, when a higher current has to be interrupted, such as a short-circuit current, the thermal energy of the arc 19 raises the gas pressure inside the gas storage chamber 30 above the predefined level, such that the valve 39 closes. Compression of the insulating gas that will quench the arc thus entirely takes place in the gas storage chamber 30 thanks to thermal energy from the arc.

Arc quenching performances of such gas blast switch notably depend on quenching gas temperature.

The particular features of embodiments of the invention will now be described with reference to FIGS. 2-6 showing a gas blast switch 100 of the same type as the gas blast switch 10 of FIG. 1, but wherein the gas storage chamber and the gas channel are optimized so as to lower the quenching gas temperature, thus improving the gas blast switch performances.

Figure 2:
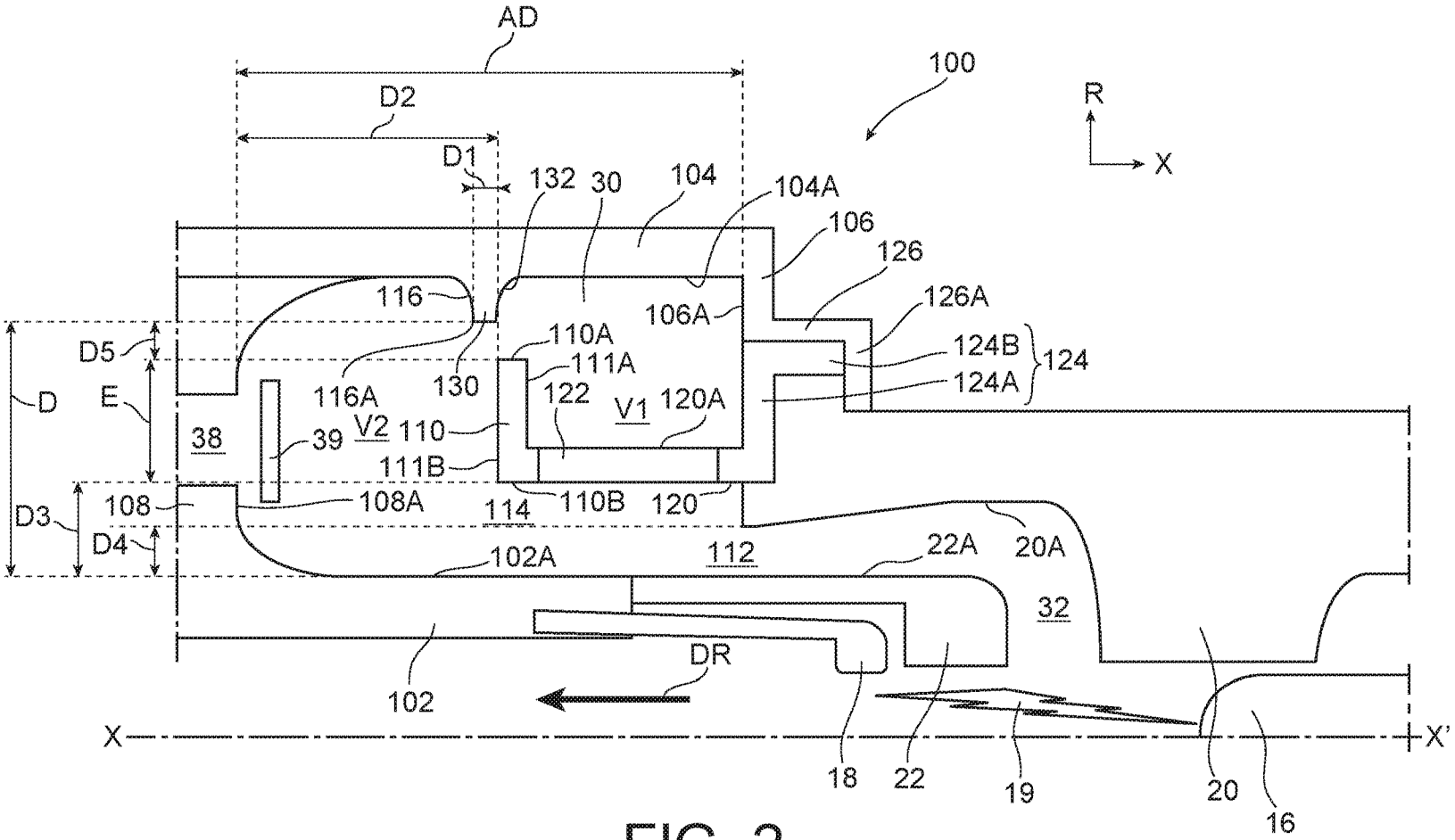
FIG. 2 is a schematic fragmentary axial half-cross-sectional view of a gas blast switch or switching chamber of a circuit breaker respectively.

As shown in FIG. 2, the gas storage chamber 30 is delimited by respective surfaces 102A, 104A, 106A, 108A of an inner wall 102, an outer wall 104, a first end wall 106 and a second end wall 108. Each of the first end wall 106 and second end wall 108 connects the inner wall 102 to the outer wall 104. Due to the globally axisymmetric shape of the gas blast switch, each of the walls 102, 104, 106, 108 is of axisymmetric shape.

A flow guiding radial wall 110 extends in the gas storage chamber 30 at a distance from each of the inner and outer walls 102, 104 and the first and second end walls 106, 108.

The flow guiding radial wall 110 is globally of plane annular shape and thus extends orthogonal to the axis XX' . Alternately, the flow guiding radial wall 110 may be globally of conical shape, with a great opening angle so as to be slightly or moderately inclined relative to the radial direction R.

The flow guiding radial wall 110 thereby partly divides the gas storage chamber 30 into two volumes, namely a first volume V1 on the side of the gas channel and a second volume V2 on the opposite side.

The flow guiding radial wall 110 thus has a first surface 111A facing the first end wall 106 and a second surface 111B facing the second end wall 108. The first surface 111A partly delimits the first volume V1 whereas the second surface 111B partly delimits the second volume V2.

Moreover, an opening 112 of the gas channel 32 through the first end wall 106 faces a first space 114 extending between the flow guiding radial wall 110 and the inner wall 102. It is to be understood that the opening 112 and the first space 114 are axially facing each other.

Figure 5:
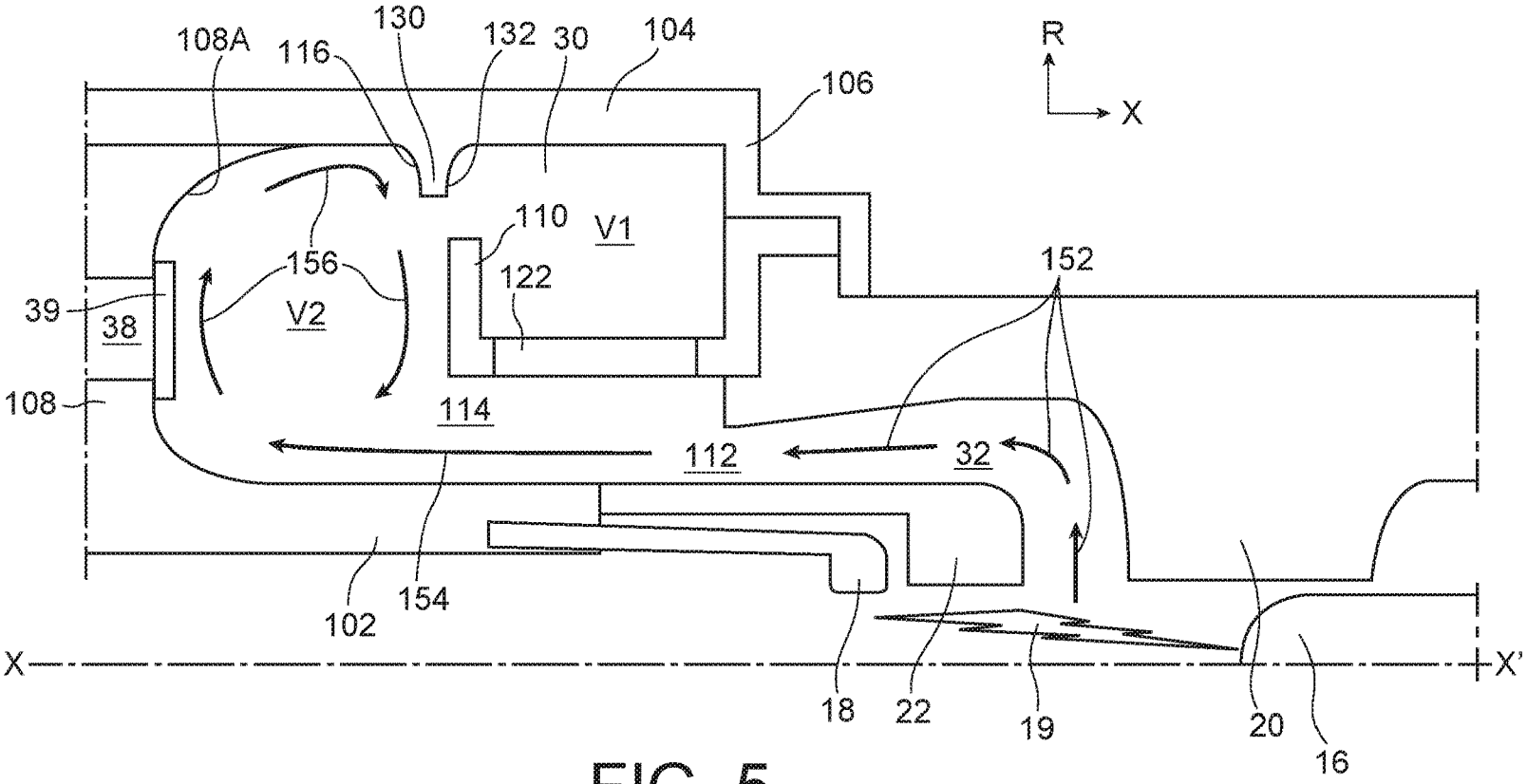
FIGS. 5 and 6 are views similar to FIG. 2 showing two operating stages of the gas blast switch of FIG. 2.

Due to the position of the opening 112, hot insulating gas flowing from the gas channel 32 into the gas storage chamber 30 predominantly flows through the first space 114 into the second volume V2, as illustrated in FIG. 5.

As shown in FIG. 2, the surface 104A of the outer wall 104 comprises a deflecting portion 116 protruding towards the inside of the gas storage chamber 30. The deflecting portion 116 faces the second end wall 108. In other words, the deflecting portion 116 partly delimits the second volume V2.

The deflecting portion 116 is arranged such that at least part of the deflecting portion 116 is offset from the flow guiding radial wall 110 in a direction DR parallel to the axis XX' and oriented from the gas channel 32 towards the gas storage chamber 30.

In the example illustrated in FIG. 2, the deflecting portion 116 is entirely offset from the flow guiding radial wall 110 in the direction DR. A radially inner end 116A of the deflecting portion 116 is indeed offset from the flow guiding radial wall 110 by an offset distance D1. The offset distance D1 is obviously measured with respect to the second surface 111B of the flow guiding radial wall 110 facing the second end wall 108.

This configuration of the flow guiding radial wall 110 and the deflecting portion 116 enables gas swirling between the second end wall 108 and the flow guiding radial wall 110, as illustrated in FIG. 5.

In this respect, the surface 108A of the second end wall 108 preferentially has a concave shape, at least in radially inner and outer portions of the surface 108A, as shown in FIG. 2. The surface 108A thus contributes to guiding gas swirling between the second end wall 108 and the flow guiding radial wall 110.

In alternative embodiments, the surface 108A of the second end wall 108 may be flat or concavely stepped.

Moreover, a maximal axial distance D2 between the radially outer end 110A of the flow guiding radial wall 110 and the second end wall 108 is, in an embodiment, between 25% and 75% of a maximal axial distance AD between the first end wall 106 and the second end wall 108. These "maximal" distances are distances measured with respect to a radially median portion of the second end wall 108, which is the furthest portion of second end wall 108 in relation to the first end wall 106 in cases where the surface 108A of the second end wall 108 has a concave shape. The maximal axial distance D2 is obviously measured with respect to the second surface 111B of the flow guiding radial wall 110.

The second volume V2 thereby preferentially occupies substantially 25% to 75% of the total volume of the gas storage chamber 30.

Moreover, a radial extent E of the flow guiding radial wall 110 is at least equal to a third of a radial distance D between the inner wall 102 and a radially inner end 116A of the deflecting portion 116. The radial extent E is, in an embodiment, greater than half of the radial distance D.

Besides, the inner surface 20A of the main nozzle 20 extends towards the gas storage chamber 30 by converging towards the outer surface 22A of the auxiliary nozzle 22 to the opening 112 of the gas channel 32.

The shape of the inner surface 20A of the main nozzle 20 thereby reinforces focusing of gas flow from the opening 112 of the gas channel 32 towards the first space 114.

In this respect, a radial extent D3 of the first space 114, measured between a radially inner end 110B of the flow guiding radial wall 110 and the inner wall 102, is preferentially greater than or equal to a radial distance D4 between the inner surface 20A of the main nozzle 20 and the outer surface 22A of the auxiliary nozzle 22 at the opening 112 of the gas channel 32.

Moreover, a radial distance D5 between the radially inner end 116A of the deflecting portion 116 and the radially outer end 110A of the flow guiding radial wall 110 is advantageously inferior or equal to the radial extent D3 of the first space 114.

In the illustrated example, the gas blast switch 100 further includes an intermediate wall 120 of annular shape connecting the flow guiding radial wall 110 to the first end wall 106 and having gas passage openings 122.

Figure 3:
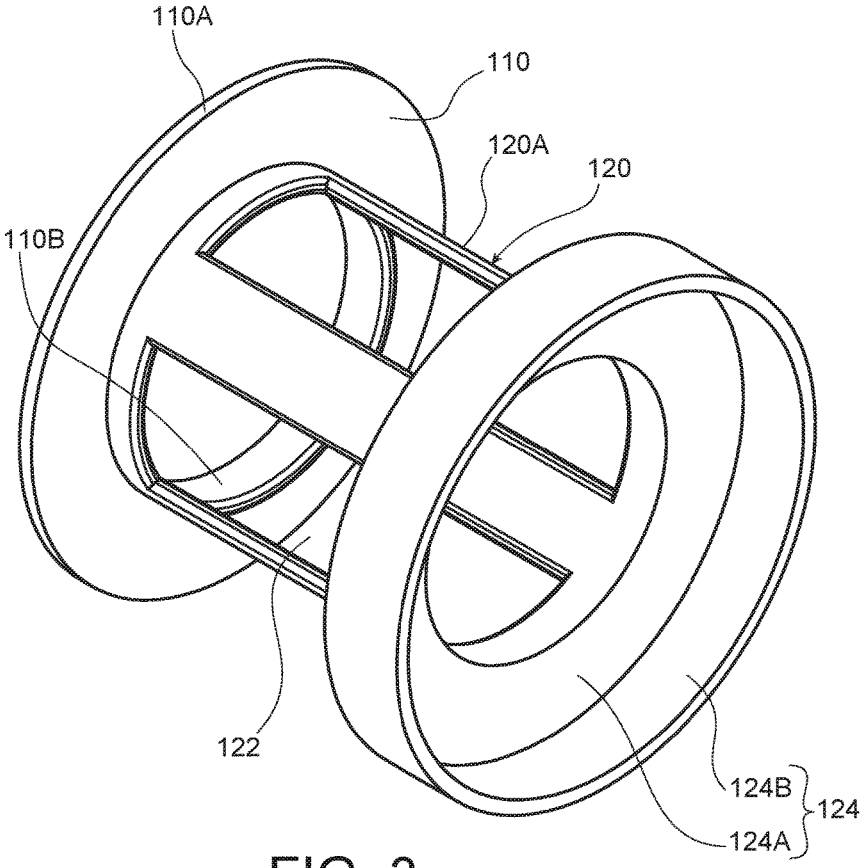
FIG. 3 is a schematic perspective view of the flow guiding radial wall and of an intermediate wall and a connection part thereof, which are part of the gas blast switch of FIG. 2.

The intermediate wall 120 is for example of cylindrical shape centered on the axis XX', with the gas passage openings 122 regularly distributed around the axis XX', as appears more clearly on FIG. 3.

The intermediate wall 120 is connected to a fastening part 124 of annular shape which is preferentially fastened to the main nozzle 20, for example by gluing, welding, clinching, or screwing. This particular feature simplifies assembling operations of the gas blast switch, by enabling the flow guiding radial wall 110, intermediate wall 120 and main nozzle 20 to be first assembled together and to be further manipulated as a single assembly while being assembled to the other parts of the gas blast switch.

In the illustrated example, the fastening part 124 has an intermediate radial wall 124A and a terminal sleeve 124B. The fastening part 124 is sandwiched between the main nozzle 20 and a connection extension 126 of the outer wall 104. The connection extension 126, in an embodiment, also comprises a terminal sleeve 126A directly fastened to the main nozzle 20.

The gas passage openings 122 preferentially extend over a major portion of the intermediate wall 120. For example, a combined passage section of the gas passage openings 122 is greater than half of a global outer surface 120A of the intermediate wall 120. The global outer surface 120A is meant to comprise the solid portions of the intermediate wall 120 and the area of the gas passage openings 122.

In the embodiment of FIG. 2, the deflecting portion 116 is concave towards the second end wall 108.

In the illustrated example, the outer wall 104 comprises a rib 130 having a filleted side forming the concave deflecting portion 116.

The rib 130 has another side 132 which is preferentially concave towards the first end wall 106.

As variants, the other side 132 may be conical or flat. This will appear more clearly in a further part of the present description regarding FIGS. 8-9.

FIGS. 4A-4K show various alternative embodiments of the flow guiding radial wall 110.

Figure 4A:
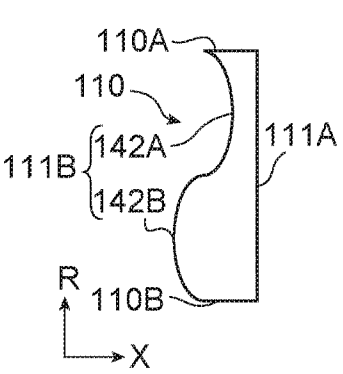
FIGS. 4A-4K are schematic fragmentary axial half-cross-sectional views of various examples of a flow guiding radial wall of the gas blast switch.

In FIG. 4A, the first surface 111A of the flow guiding radial wall 110 is a plane surface, whereas the second surface 111B has an outer concave annular portion 142A connected to an inner convex annular portion 142B.

Figure 4B:
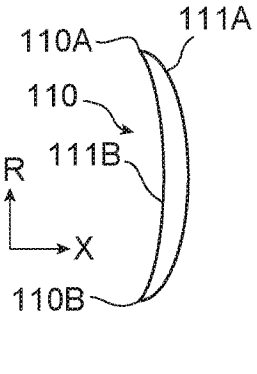

In FIG. 4B, the first surface 111A of the flow guiding radial wall 110 is a convex surface, and the second surface 111B is a concave surface.

Figure 4C:
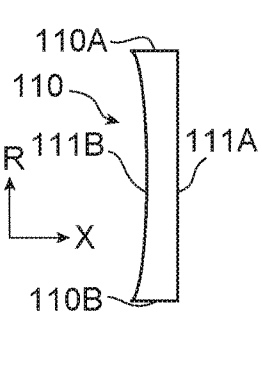

In FIG. 4C, the first surface 111A of the flow guiding radial wall 110 is a plane surface, and the second surface 111B is a concave surface.

Figure 4D:
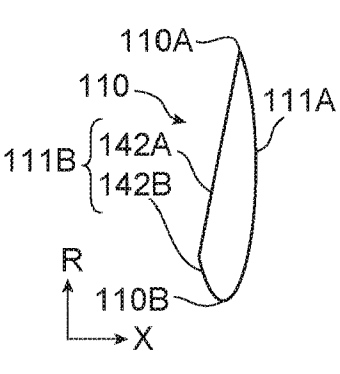

In FIG. 4D, the first surface 111A of the flow guiding radial wall 110 is a convex surface, whereas the second surface 111B has an outer plane conical portion 142A and an inner convex annular portion 142B.

Figure 4E:
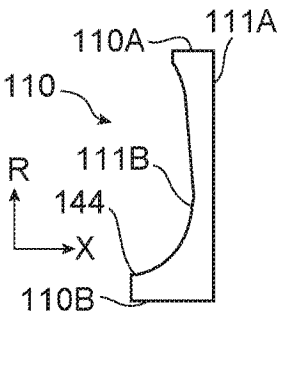

In FIG. 4E, the first surface 111A of the flow guiding radial wall 110 is a plane surface, and the second surface 111B is a concave surface. The flow guiding radial wall 110 further comprises a base skirt 144 protruding towards the second volume V2 at the radially inner end 110B of the flow guiding radial wall 110.

Figure 4F:
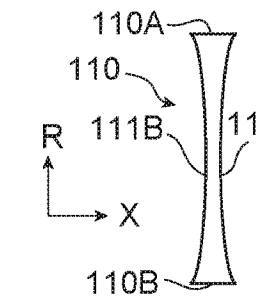
Figure 4G:
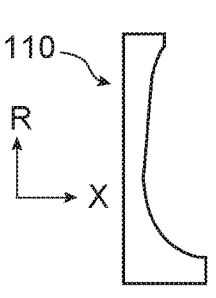
Figure 4H:
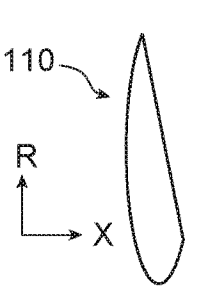
Figure 4I:
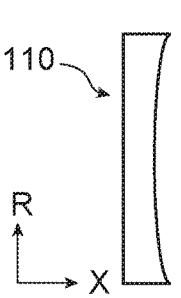
Figure 4J:
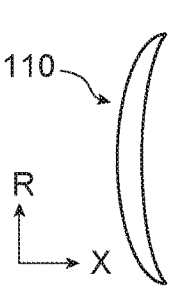
Figure 4K:
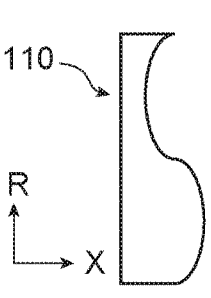

In FIG. 4F, both first surface 111A and second surface 111B of the flow guiding radial wall 110 are concave surfaces.

The respective flow guiding radial wall 110 configurations illustrated in FIG. 4G-4K can be deduced respectively from the flow guiding radial wall 110 of FIG. 4E-4A by symmetry with respect to a radial plane.

Operation of the gas blast switch 100 of FIG. 2 will now be described with reference to FIGS. 5 and 6.

FIG. 5 shows the gas blast switch 100 during a pressurization stage.

Insulating gas heated by an arc 19 flows through the gas channel (arrows 152) and enters into the gas storage chamber 30. Here, the position of the opening 112 of the gas channel 32 facing the first space 114 enables such hot gas to flow mainly into the second volume V2 (arrow 154).

The flow guiding radial wall 110 and the deflecting portion 116 cooperate to induce gas swirling (arrows 156) in the second volume V2, in other words between the second end wall 108 and the flow guiding radial wall 110.

Mixing of gas heated by the arc on the one hand and cold gas previously stored in the first volume V1 on the other hand is thereby minimized.

Figure 6:
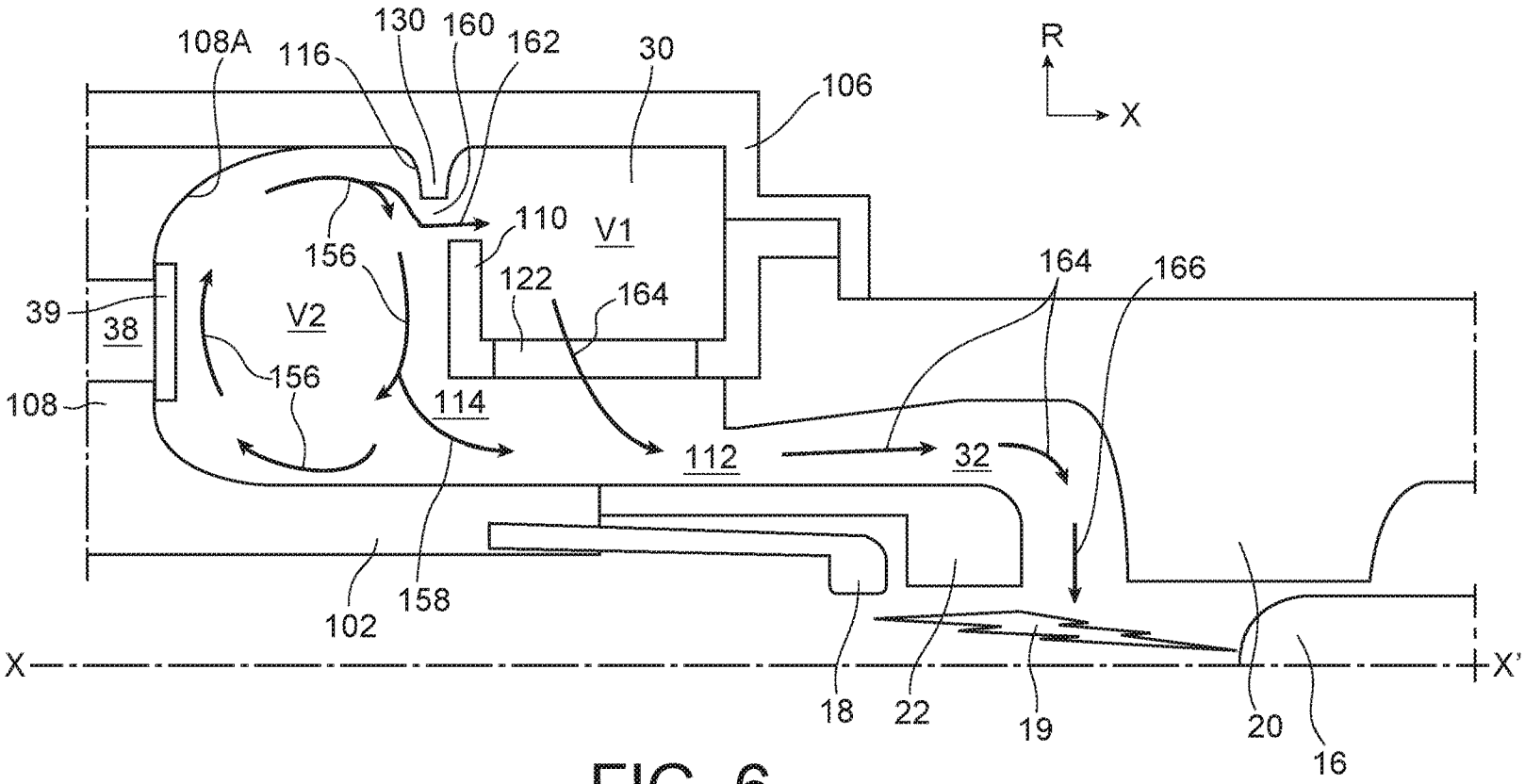

FIG. 6 shows the gas blast switch 100 during the subsequent arc extinction stage.

In this stage, the spacing between the flow guiding radial wall 110 and the inner and outer walls 102, 104 enable the hot gas from the second volume V2 to flow through the first space 114 between the flow guiding radial wall 110 and the inner wall 102 (arrow 158) and through a second space 160 between the flow guiding radial wall 110 and the outer wall 104 (arrow 162). The hot gas in the second volume V2 thereby pushes the cold gas from the first volume V1 into the gas channel 32 (arrows 164), while minimizing mixing of hot and cold gases. This way, cold gas is ejected out of the gas channel into the arcing region before hot gas (arrow 166).

Arc cooling is thereby improved, and so are the overall switching performances of such gas blast switch.

FIGS. 7 to 10 show other exemplary embodiments of the gas blast switch 100, which are similar to the embodiment of FIG. 2 but which show alternative configurations of the outer wall 104 and, in particular, of deflecting portion 116.

Figure 7:
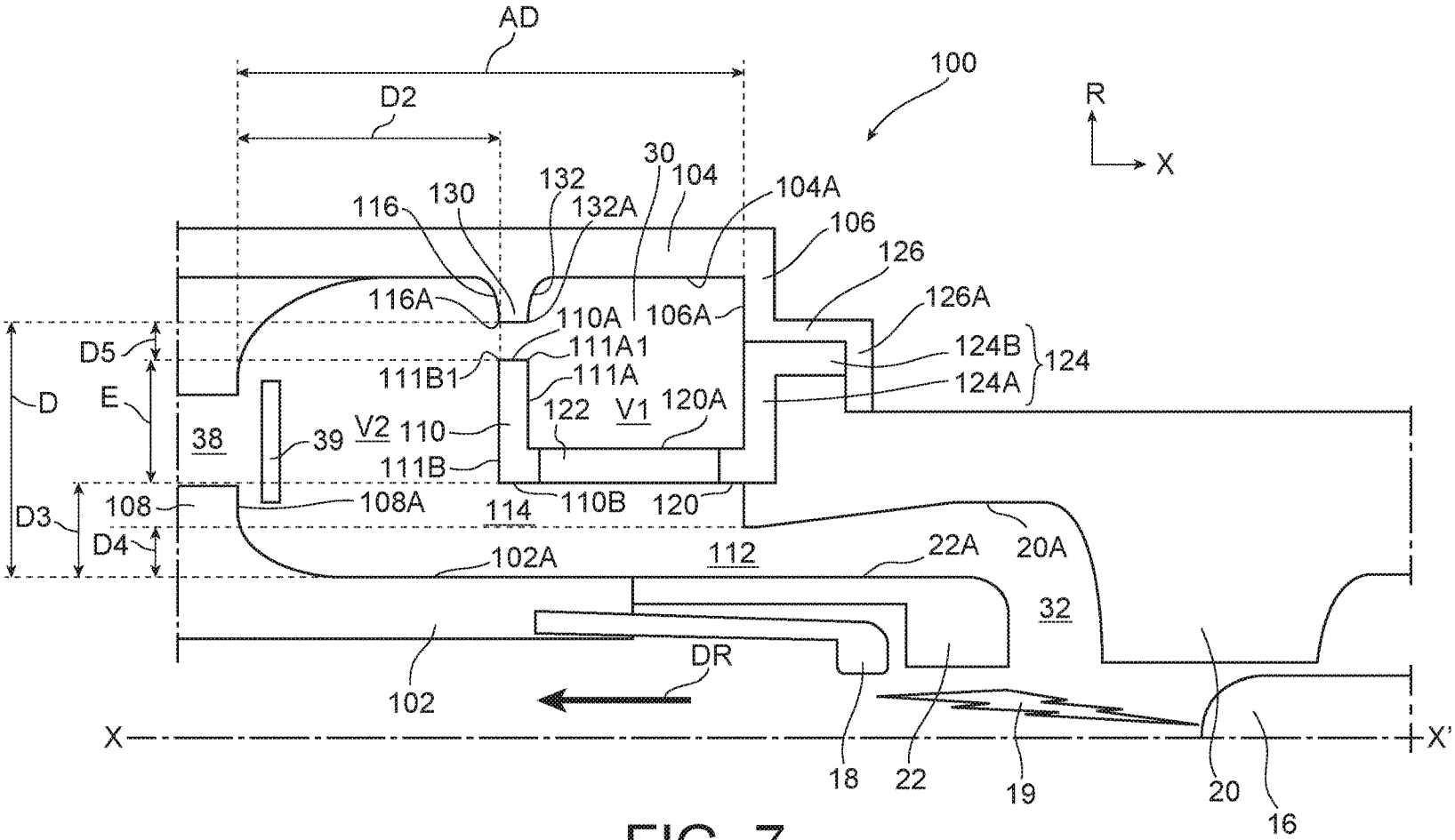
FIG. 7 is a schematic fragmentary axial half-cross-sectional view of a gas blast switch or switching chamber of a circuit breaker respectively.

In FIG. 7, the radially inner end 116A of the deflecting portion 116 is radially aligned with a radially outer end 111B1 of the second face 111B of the flow guiding radial wall 110. It is to be noted that even in such case, most of the deflecting portion 116 remains offset from the flow guiding radial wall 110 in the direction DR.

In the exemplary embodiment disclosed in FIG. 7, a radially inner end 132A of the other side 132 of the rib 130 is radially aligned with a radially outer end 111A1 of the first face 111A of the flow guiding radial wall 110.

Figure 8:
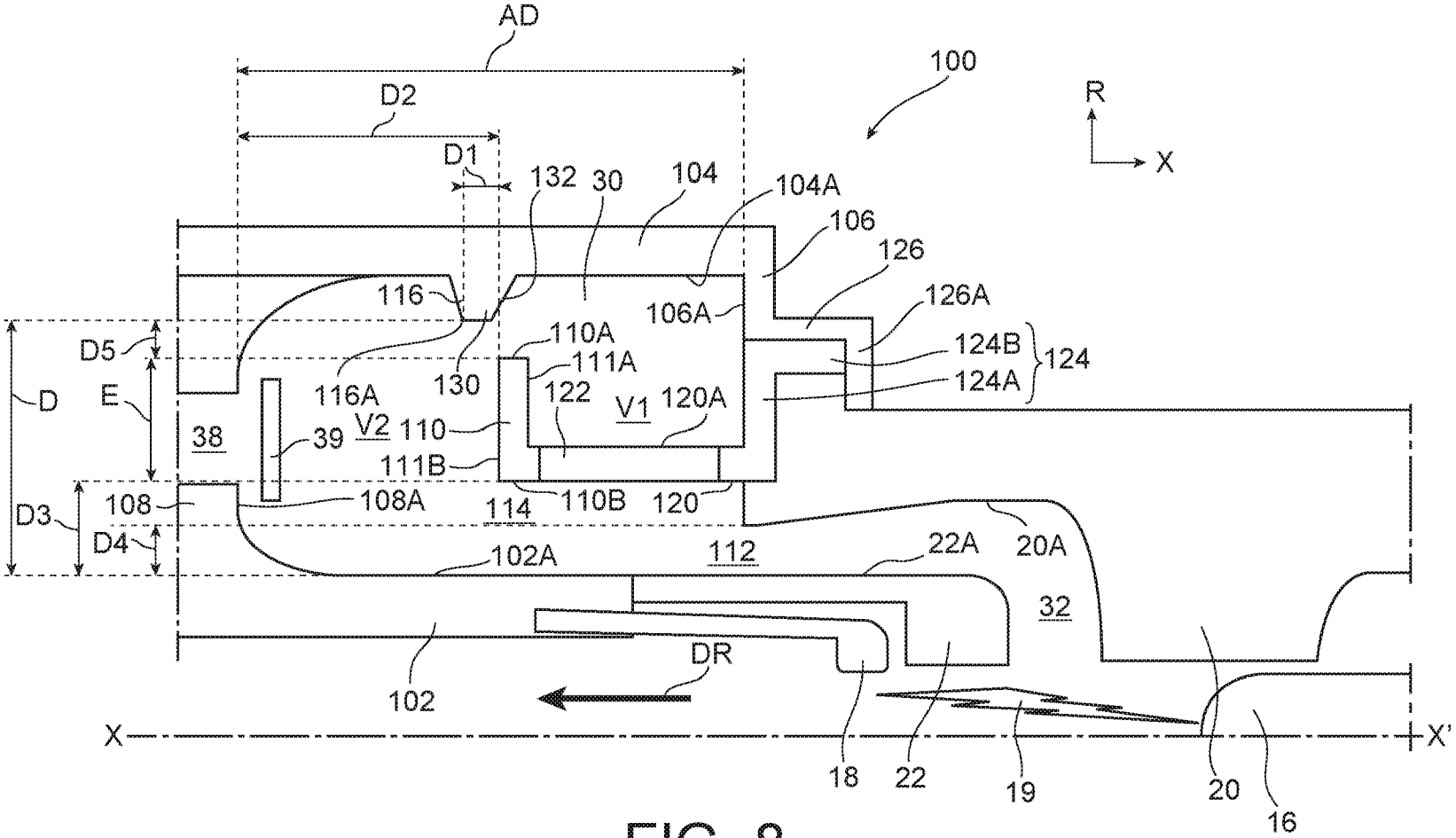
FIG. 8 is a schematic fragmentary axial half-cross-sectional view of a gas blast switch or switching chamber of a circuit breaker respectively.

In FIG. 8, the deflecting portion 116 is of conical shape and converges towards the gas channel 32. In other words, the deflecting portion is flat and beveled when seen in half cross-section as in FIG. 8.

The other side 132 of the rib 130 is preferentially also of conical shape, but converges towards the second end wall 108, as shown in FIG. 8.

As a variant, the other side 132 of the rib 130 of FIG. 8 may be concave towards the first end wall 106 as in FIG. 2, or flat.

Figure 9:
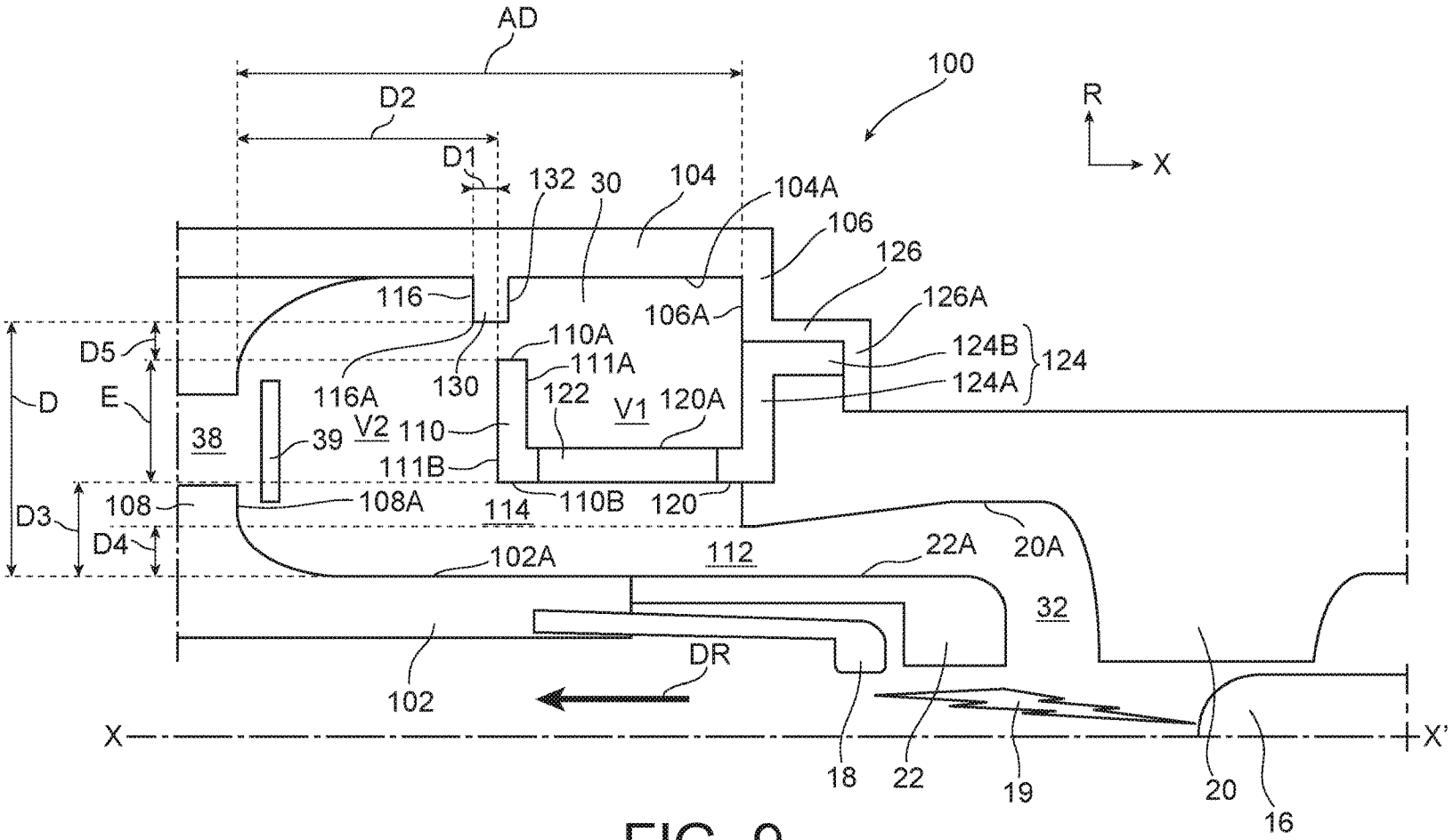
FIG. 9 is a schematic fragmentary axial half-cross-sectional view of a gas blast switch or switching chamber of a circuit breaker respectively.

In FIG. 9, the deflecting portion 116 is flat and orthogonal to the axis XX'. In such case, the deflecting portion 116 is totally offset from the flow guiding radial wall 110 in the direction DR parallel to the axis XX' and oriented from the gas channel 32 towards the gas storage chamber 30, so as to ensure gas swirling induction as explained above.

The other side 132 of the rib 130 is preferentially also flat, as shown in FIG. 9, but may alternatively be concave towards the first end wall 106, as in FIG. 2, or conical as in FIG. 8.

Figure 10:
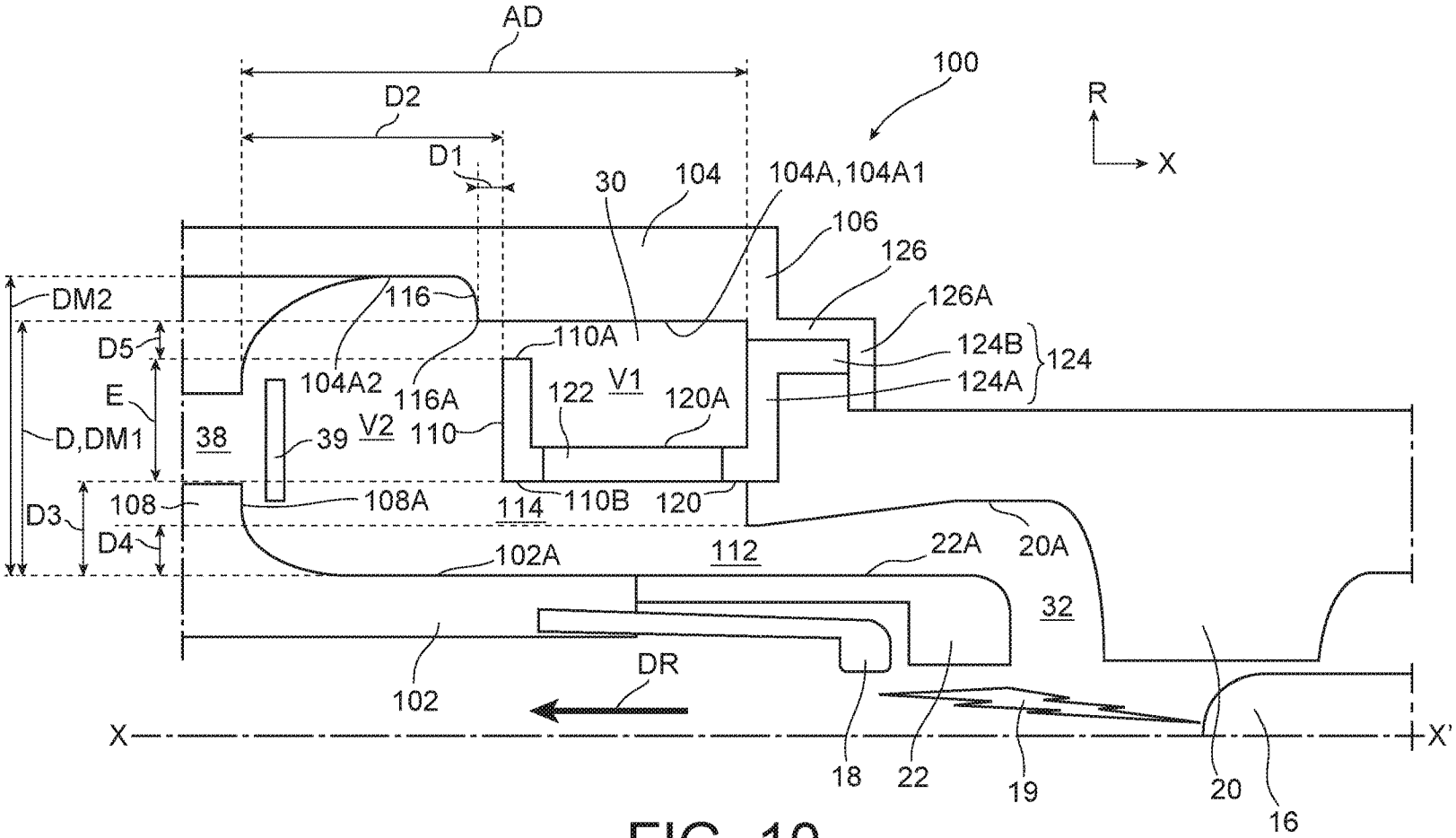
FIG. 10 is a schematic fragmentary axial half-cross-sectional view of a gas blast switch or switching chamber of a circuit breaker respectively.

In FIG. 10, the outer wall 104 comprises a step instead of a rib. In other words, the surface 104A of the outer wall 104 comprises a first portion 104A1 connected to the first end wall and having a first diameter DM1, corresponding to the above-mentioned distance D, and a second portion 104A2 offset from the first portion 104A1 in the direction DR (the direction parallel to the axis XX' and oriented from the gas channel 32 towards the gas storage chamber 30). The second portion 104A2 has a second diameter DM2 greater than the first diameter DM1, and the deflecting portion 116 connects the first portion 104A1 to the second portion 104A2.

In the illustrated example of FIG. 10, the deflecting portion 116 is concave as in FIG. 2, but as variants, the deflecting portion 116 of FIG. 10 may be replaced by deflecting portions similar to those of FIG. 8 or FIG. 9.

The gas blast switch embodiments of FIG. 7-10 operate similarly to the gas blast switch of FIG. 2.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A gas blast switch, comprising:

two arcing contacts movable relative to one another along an axis, a main nozzle and an auxiliary nozzle both made from insulation-material and extending around the axis such as to delimit an arcing region, a gas storage chamber for storing quenching gas, the gas storage chamber being delimited by respective surfaces of radially opposite inner and outer walls and of axially opposite first and second end walls, a gas channel extending between an outer surface of the auxiliary nozzle and an inner surface of the main nozzle and connecting the gas storage chamber to the arcing region through an opening in the first end wall, and a flow guiding radial wall extending in the gas storage chamber at a distance from each of the inner and outer walls and the first and second end walls, wherein the opening of the gas channel through the first end wall faces a first space between the flow guiding radial wall and the inner wall, the surface of the outer wall comprises a deflecting portion protruding towards the inside of the gas storage chamber and facing the second end wall, and at least part of the deflecting portion is offset from the flow guiding radial wall in a direction parallel to the axis and oriented from the gas channel towards the gas storage chamber.

2. The gas blast switch according to claim 1, wherein the inner surface of the main nozzle extends towards the gas storage chamber by converging towards the outer surface of the auxiliary nozzle.

3. The gas blast switch according to claim 1, further including an intermediate wall of annular shape connecting the flow guiding radial wall to the first end wall and having gas passage openings.

4. The gas blast switch according to claim 3, wherein the intermediate wall is fastened to the main nozzle.

5. The gas blast switch according to claim 3, wherein a combined passage section of the gas passage openings is at least equal to half of an outer surface of the intermediate wall.

6. The gas blast switch according to claim 1, wherein the deflecting portion is concave towards the second end wall.

7. The gas blast switch according to claim 1, wherein the deflecting portion is of conical shape converging towards the gas channel.

8. The gas blast switch according to claim 1, wherein the deflecting portion is flat, orthogonal to the axis, and totally offset from the flow guiding radial wall in the direction parallel to the axis and oriented from the gas channel towards the gas storage chamber.

9. The gas blast switch according to claim 1, wherein the outer wall comprises a rib having a side forming the deflecting portion.

10. The gas blast switch according to claim 1, wherein the surface of the outer wall comprises a first portion connected to the first end wall and having a first diameter, and a second portion offset from the first portion in the direction parallel to the axis and oriented from the gas channel towards the gas storage chamber, wherein the second portion has a second diameter greater than the first diameter, and wherein the deflecting portion connects the first portion to the second portion.

11. The gas blast switch according to claim 1, wherein a radial extent of the first space is greater than or equal to a radial distance between the inner surface of the main nozzle and the outer surface of the auxiliary nozzle at the opening of the gas channel through the first end wall.

12. The gas blast switch according to claim 1, wherein the surface of the second end wall is at least partly of concave shape.

13. The gas blast switch according to claim 1, wherein a radial distance between a radially inner end of the deflecting portion and a radially outer end of the flow guiding radial wall is inferior or equal to a radial extent of the first space.

14. The gas blast switch according to any claim 1, further comprising a compression chamber separated from the gas storage chamber by the second end wall, wherein the second end wall comprises an opening provided with a valve configured to close the opening when gas pressure in the gas storage chamber reaches a predetermined level.

* * * * *